US011499422B2

(12) United States Patent
Sun et al.

(10) Patent No.: US 11,499,422 B2
(45) Date of Patent: Nov. 15, 2022

(54) METHOD FOR EVALUATING GAS WELL PRODUCTIVITY WITH ELIMINATING INFLUENCE OF LIQUID LOADING

(71) Applicant: Exploration & Production Research Institute of SINOPEC North-China Oil & Gas Company, Henan (CN)

(72) Inventors: Huanquan Sun, Henan (CN); Faqi He, Henan (CN); Yongyi Zhou, Henan (CN); Xiaobo Liu, Henan (CN); Yongming He, Henan (CN); Linsong Liu, Henan (CN); Kui Chen, Henan (CN); Tongsheng Cao, Henan (CN); Yaonan Yu, Henan (CN); Yan Chen, Henan (CN)

(73) Assignee: Exploration & Production Research Institute of SINOPEC North-China Oil & Gas Company, Henan (CN)

( * ) Notice: Subject to any disclaimer, the term of this patent is extended or adjusted under 35 U.S.C. 154(b) by 50 days.

(21) Appl. No.: 17/151,679

(22) Filed: Jan. 19, 2021

(65) Prior Publication Data

US 2021/0140314 A1 May 13, 2021

(51) Int. Cl.
*E21B 49/00* (2006.01)
*E21B 47/06* (2012.01)

(52) U.S. Cl.
CPC ..... *E21B 49/008* (2013.01); *E21B 47/06* (2013.01)

(58) Field of Classification Search
CPC ..... E21B 47/06; E21B 49/008
See application file for complete search history.

(56) References Cited

U.S. PATENT DOCUMENTS

| | | | | |
|---|---|---|---|---|
| 7,275,599 | B2 * | 10/2007 | Wilde | E21B 43/12 166/372 |
| 7,954,547 | B2 * | 6/2011 | Lowe | E21B 43/122 166/250.15 |
| 9,470,076 | B2 * | 10/2016 | Edwards | E21B 43/121 |
| 9,638,001 | B2 * | 5/2017 | Veeken | E21B 34/10 |
| 9,790,773 | B2 * | 10/2017 | Aman | E21B 43/14 |
| 10,487,633 | B2 * | 11/2019 | Aman | E21B 43/121 |
| 2004/0200615 | A1 * | 10/2004 | Wilde | E21B 43/122 166/250.15 |

(Continued)

FOREIGN PATENT DOCUMENTS

| | | | | |
|---|---|---|---|---|
| CN | 108131130 A | * | 6/2018 | E21B 47/00 |
| TW | 201621148 A | * | 6/2016 | E21B 43/121 |

*Primary Examiner* — John Fitzgerald

(57) ABSTRACT

A method for evaluating a gas well productivity with eliminating an influence of liquid loading includes steps of: collecting basic data of a liquid loading gas well; according to a relative density of natural gas, a formation depth, and a casing pressure during a productivity test, determining a pressure generated by a static gas column in an annular space between a casing and a tubing from a well head to a bottomhole of the gas well, and obtaining a bottomhole pressure without liquid loading; according to a pseudo-pressure of a formation pore pressure, pseudo-pressures of the bottomhole pressure respectively under the conditions of liquid loading and no liquid loading, and a production rate under the condition of liquid loading, determining a production rate without liquid loading, and determining an absolute open flow rate with eliminating the influence of liquid loading.

3 Claims, 1 Drawing Sheet

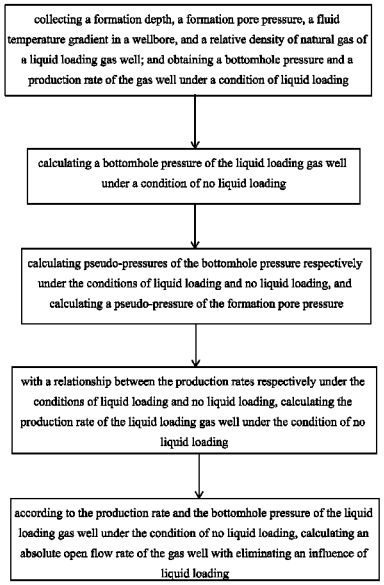

(56) References Cited

U.S. PATENT DOCUMENTS

| | | | | |
|---|---|---|---|---|
| 2011/0146999 | A1* | 6/2011 | Stanton | E21B 43/122<br>222/129 |
| 2017/0074084 | A1* | 3/2017 | Gettis | B01D 19/0042 |

* cited by examiner

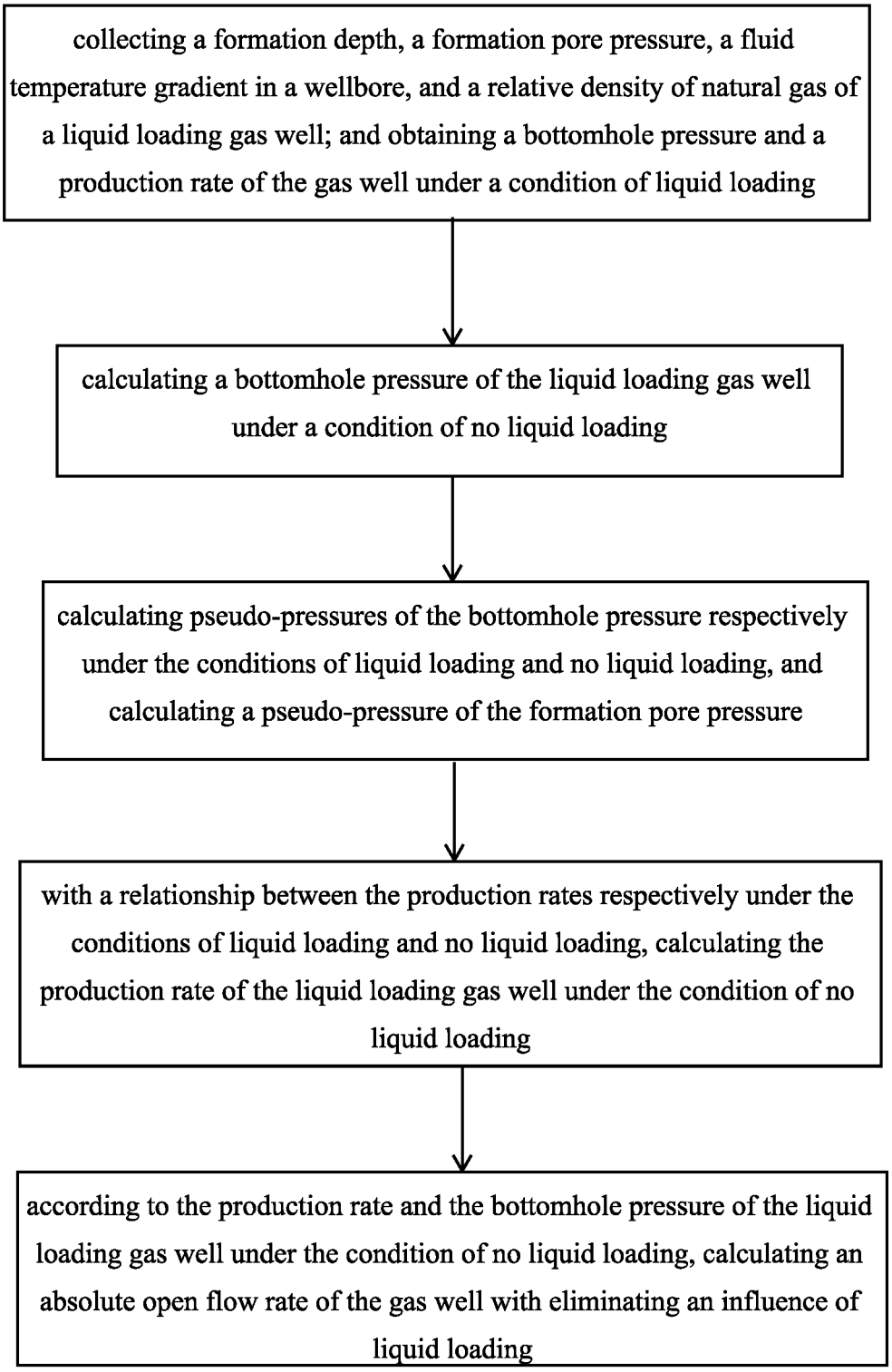
collecting a formation depth, a formation pore pressure, a fluid temperature gradient in a wellbore, and a relative density of natural gas of a liquid loading gas well; and obtaining a bottomhole pressure and a production rate of the gas well under a condition of liquid loading
calculating a bottomhole pressure of the liquid loading gas well under a condition of no liquid loading
calculating pseudo-pressures of the bottomhole pressure respectively under the conditions of liquid loading and no liquid loading, and calculating a pseudo-pressure of the formation pore pressure
with a relationship between the production rates respectively under the conditions of liquid loading and no liquid loading, calculating the production rate of the liquid loading gas well under the condition of no liquid loading
according to the production rate and the bottomhole pressure of the liquid loading gas well under the condition of no liquid loading, calculating an absolute open flow rate of the gas well with eliminating an influence of liquid loading

METHOD FOR EVALUATING GAS WELL PRODUCTIVITY WITH ELIMINATING INFLUENCE OF LIQUID LOADING

CROSS REFERENCE OF RELATED APPLICATION

The application claims priority under 35 U. S. C. 119(a-d) to CN 202010260769.2, filed Apr. 3, 2020.

BACKGROUND OF THE PRESENT INVENTION

Field of Invention

The present invention relates to a field of gas field production and research, and more particularly to a method for evaluating a gas well productivity with eliminating an influence of liquid loading.

Description of Related Arts

During the production process of the gas reservoir with edge and bottom water or the low-permeability gas reservoir with high-water saturation, if the energy of the gas well is enough, the liquid in the wellbore is able to be carried out of the well head; if the energy of the gas well is not enough and the production rate is unable to reach the flow rate of completely carrying the liquid, water (liquid) in the wellbore cannot continuously flow out of the well head, causing that a part of the liquid settles and accumulates in the bottomhole, and liquid loading occurs in the bottomhole. How to quantitatively reflect the influence of liquid loading on the gas well productivity and accurately obtain the actual productivity of the gas well without the effect of liquid loading have been rarely reported. Therefore, based on the theoretical derivation of seepage mechanics, the present invention provides a gas well productivity evaluation method with eliminating the influence of liquid loading.

SUMMARY OF THE PRESENT INVENTION

An object of the present invention is to provide a method for evaluating a gas well productivity with eliminating an influence of liquid loading, which fills a gap of quantitatively eliminating the influence of liquid loading in a gas well productivity evaluation study area.

The present invention adopts technical solutions as follows.

A method for evaluating a gas well productivity with eliminating an influence of liquid loading comprises steps of:

(1) collecting basic data of a liquid loading gas well, comprising a relative density $\gamma_g$ of natural gas, a formation depth H, a formation pore pressure $P_R$, and a casing pressure $P_t$, a bottomhole pressure $P_{wfac}$, and a production rate $q_{gac}$ during a productivity test;

(2) based on the relative density $\gamma_g$ of natural gas, the formation depth Hand the casing pressure $P_t$ of the gas well during the productivity test, which are obtained in the step (1), determining a pressure generated by a static gas column in an annular space between a casing and a tubing from a well head to a bottomhole of the gas well, and calculating a bottomhole pressure $P_{wfn}$ of the gas well under a condition of no liquid loading;

(3) according to a pseudo-pressure equation of $$\Psi(\text{Press}) = 2\int_{P_a}^{Press} \frac{P}{u_g Z} dP,$$

calculating a pseudo-pressure $\Psi(P_R)$ of the formation pore pressure, a pseudo-pressure $\Psi(P_{wfn})$ of the bottomhole pressure under the condition of no liquid loading, and a pseudo-pressure $\Psi(P_{wfac})$ of the bottomhole pressure under a condition of liquid loading;

wherein: $P_a$ represents an atmospheric pressure, $u_g$ represents a gas viscosity, and Z represents a gas deviation factor;

(4) according to the production rate $q_{gn}$, of the gas well under the condition of liquid loading in the step (1) and the pseudo-pressures $\Psi(P_R)$, $\Psi(P_{wfn})$ and $\Psi(P_{wfac})$ in the step (3), determining a production rate $q_{gn}$ of the gas well under the condition of no liquid loading, wherein: a calculation equation of the production rate $q_{gn}$ for the gas well under the condition of no liquid loading is:

$$q_{gn} = q_{gac}\frac{\Psi(P_R) - \Psi(P_{wfn})}{\Psi(P_R) - \Psi(P_{wfac})},$$

and (5) according to the production rate $q_{gn}$ of the gas well under the condition of no liquid loading obtained in the step (4) and the bottomhole pressure $P_{wfn}$ of the gas well under the condition of no liquid loading obtained in the step (2), calculating an absolute open flow rate of the gas well with eliminating the influence of liquid loading.

The above technical solutions of the present invention have beneficial effects as follows.

For the gas well productivity evaluation method with eliminating the influence of liquid loading provided by the present invention, according to the formation depth of the gas well, the relative density of natural gas and the casing pressure, the bottomhole pressure under the condition of no liquid loading is determined; then, based on a relationship between the gas well production rate under the condition of liquid loading and that under the condition of no liquid loading, the production rate of the gas well with eliminating the influence of liquid loading (that is the gas well production rate under the condition of no liquid loading) is calculated; according to the production rate and the bottomhole pressure under the condition of no liquid loading, the absolute open flow rate of the gas well with eliminating the influence of liquid loading is determined. The evaluation method for the gas well productivity provided by the present invention has the high accuracy, considers the quantitative influence of liquid loading on the gas well productivity evaluation, and fills the gap of quantitatively eliminating the influence of liquid loading on the gas well productivity evaluation; moreover, the evaluation method for the gas well productivity provided by the present invention is simple, effective and practical, and has the good operability and promotional values.

Preferably, a calculation equation of the absolute open flow rate of the gas well with eliminating the influence of liquid loading is:

$$q_{AOFN} = 6q_{gac}\frac{\Psi(P_R) - \Psi(P_{wfn})}{\Psi(P_R) - \Psi(P_{wfaz})}\frac{1}{\sqrt{1 + 48\left(1 - \frac{P_{wfn}^2}{P_R^2}\right)} - 1};$$

wherein: $q_{AOFN}$ represents the absolute open flow rate of the gas well with eliminating the influence of liquid loading.

Preferably, the collected basic data of the liquid loading gas well further comprise a temperature gradient Tad of fluid in a wellbore during the productivity test and a well head fluid temperature $T_{head}$ during the productivity test;

based on the formation depth H obtained in the step (1), the temperature gradient $T_{grad}$ of fluid in the wellbore, and the well head fluid temperature $T_{head}$ an average temperature $\overline{T}$ of fluid in the annular space between the casing and the tubing is obtained with a reservoir engineering method;

based on the relative density $\gamma_g$ of natural gas, the formation depth H and the casing pressure $P_t$ of the gas well during the productivity test, which are obtained in the step (1), and the calculated average temperature $\overline{T}$ of fluid in the annular space between the casing and the tubing, which is obtained above, the bottomhole pressure $P_{wfn}$ of the gas well under the condition of no liquid loading can be obtained by solving a nonlinear equation of $$P_{wfn} = P_t e^{\frac{0.03415\gamma_g H}{\overline{T}\overline{Z}}}$$

iteratively, wherein: $\overline{Z}$ represents an average gas deviation factor, which is a function of the average temperature $\overline{T}$ of fluid in the annular space between the casing and the tubing and a wellbore average pressure of $\overline{P}=(P_t+P_{wfn}/2$, and can be calculated by the reservoir engineering method;

or, with a model of $$P_{wfn} = P_t + \int_0^H 0.03415\frac{r_g}{ZT}dh,$$

the bottomhole pressure $P_{wfn}$ of the gas well under the condition of no liquid loading is calculated, wherein: T represents a wellbore gas temperature at a depth of h in the annular space between the casing and the tubing, and Z represents the gas deviation factor.

BRIEF DESCRIPTION OF THE DRAWINGS

FIG. 1 is a flow chart of a method for evaluating a gas well productivity with eliminating an influence of liquid loading according to a preferred embodiment.

DETAILED DESCRIPTION OF THE PREFERRED EMBODIMENT

The preferred embodiment below is for illustrating the technical solutions of the present invention, but the protection scope of the present invention is not limited thereto.

1. Brief Introduction of Gas Well Production Rate Equation Based on Pseudo-Pressure Form According to a theory of seepage mechanics, the gas well production rate equation based on the pseudo-pressure form can be derived as follows:

$$q_g = [\Psi(P_R) - \Psi(P_{wf})]\frac{\pi khT_{sc}}{P_{sc}T}\frac{1}{\mathrm{Ln}\frac{r_e}{r_w}}; \quad (1)$$

wherein: $q_g$ represent a production rate of a gas well; k represents a formation permeability, in unit of mD; h represents an effective formation thickness, in unit of m; $T_{sc}$ represents a surface temperature under standard conditions, in unit of K; $P_{sc}$ represents a surface pressure under the standard conditions, in unit of MPa; T represents a formation temperature, in unit of K; $r_e$ represents a gas supply radius of the gas well, in unit of m; $r_w$ represents a radius of a wellbore, in unit of m; Ψ(Press) represents a pseudo-pressure of a pressure $P_{ress}$, and a definition of Ψ(Press) is:

$$\Psi(\mathrm{Press}) = 2\int_{p_a}^{press}\frac{P}{u_g Z}dP; \quad (2)$$

wherein: $P_a$ represents an atmospheric pressure, in unit of MPa; $u_g$ represents a gas viscosity, in unit of mPa·s, which can be obtained through the empirical equation, or through the interpolation calculation according to the PVT (Pressure-Volume-Temperature) parameter list obtained in the experiment; and Z represents a gas deviation factor.

(2) Derivation of Quantitative Evaluation Model about Influence of Liquid Loading on Gas Well Production Rate If ignoring the damages of liquid loading in the gas well to the reservoir, a bottomhole pressure of the gas well under a condition of liquid loading is assumed as $P_{wfac}$, and a corresponding production rate is $q_{gac}$; a bottomhole pressure of the gas well with eliminating the influence of liquid loading is assumed as $P_{wfn}$, and a corresponding production rate is $q_{gn}$; it can be obtained from the equation (1) that:

$$q_{gn} = q_{gac}\frac{\Psi(P_R) - \Psi(P_{wfn})}{\Psi(P_R) - \Psi(P_{wfac})}; \quad (3)$$

the equation (3) is the quantitative evaluation model about the influence of liquid loading on the gas well production rate; once the bottomhole pressure $P_{wfac}$ of the gas well under the condition of liquid loading and the bottomhole pressure $P_{wfn}$ of the—gas well under the condition of no liquid loading are obtained, the influence of liquid loading on the gas well production rate can be quantitatively evaluated through the equation (3).

After liquid loading occurs in the gas well, the bottomhole pressure $P_{wfac}$ can be directly detected through the pressure meter. When liquid loading occurs in the gas well, the bottomhole pressure under the condition of no liquid loading cannot be directly measured and can only be obtained through other ways.

If there is liquid loading in the gas well, a liquid column exists in the annular space between the casing and the tubing; a casing pressure plus a pressure generated by a static gas column and the liquid column in the annular space between the casing and the tubing is namely the bottomhole pressure under the condition of liquid loading. If there is no liquid loading in the gas well, pure gas exists in the annular space between the casing and the tubing; the bottomhole pressure is equal to the casing pressure $P_t$ plus the pressure generated by the static gas column in the annular space between the casing and the tubing. The corresponding bottomhole pressure $P_{wfn}$ under the condition of no liquid loading can be calculated by an iterative method, according to a bottomhole pressure model of static gas column in the equation (4) that:

$$P_{wfn} = P_t e^{\frac{0.03415\gamma_g H}{\overline{T}\overline{Z}}}. \quad (4)$$

(3) Derivation of productivity evaluation model with eliminating influence of liquid loading in gas well The general form of the gas well productivity equation is:

$$P_R^2-P_{wf}^2=Aq_g+Bq_g^2 \quad (5);$$

generally, an absolute open flow rate $q_{AOF}$ is used to represent the gas well productivity; the absolute open flow rate of the gas well is a corresponding gas well productivity when a well flowing bottomhole pressure is equal to the atmospheric pressure $P_a$; it can be obtained through the equation (5) that:

$$q_{AOF}=\frac{\sqrt{A^2+4B(P_R^2-P_a^2)}-A}{2B}. \quad (6)$$

Based on the different well flowing bottomhole pressures and the corresponding production rate data, through regressing and fitting the equation (5), values of the parameters A and B can be obtained; through putting the values into the equation (6), the calculation equation of the absolute open flow rate is obtained. Conventionally, the most widely used calculation equation of the absolute open flow rate is the equation (7) established by Yuanqian Chen that:

$$q_{AOF}=\frac{6q_g}{\sqrt{1+48\left(1-\frac{P_{wf}^2}{P_R^2}\right)}-1}. \quad (7)$$

Through putting the production rate $q_{gn}$ and the bottomhole pressure $P_{wfn}$ of the gas well under the condition of no liquid loading into the equation (7), the corresponding absolute open flow rate $q_{AOFN}$ of the gas well under the condition of no liquid loading is obtained that:

$$q_{AOFN}=\frac{6q_{gn}}{\sqrt{1+48\left(1-\frac{P_{wfn}^2}{P_R^2}\right)}-1}. \quad (8)$$

Through the equations (3) and (8), it is obtained that:

$$q_{AOFN}=6q_{gac}\frac{\Psi(P_R)-\Psi(P_{wfn})}{\Psi(P_R)-\Psi(P_{wfac})}\frac{1}{\sqrt{1+48\left(1-\frac{P_{wfn}^2}{P_R^2}\right)}-1}; \quad (9)$$

the equation (9) is the gas well productivity evaluation model with eliminating the influence of liquid loading.

In the above equations, $\gamma_g$ represents the relative density of natural gas, which is non-dimensional and fractional; H represents the formation depth, in unit of m; $P_R$ represents the formation pore pressure, in unit of MPa; $T_{grad}$ represents the temperature gradient of fluid in the wellbore, in unit of ° C./(100 m); $T_{head}$ represents the well head fluid temperature during the productivity test, in unit of K; $P_t$ represents the casing pressure during the productivity test; $P_{wfac}$ represents the bottomhole pressure under the condition of liquid loading during the productivity test, in unit of MPa; $q_{gac}$ represents the stable production rate under the condition of liquid loading during the productivity test, in unit of $m^3/d$; $\overline{T}$ represents the average temperature of fluid in the annular space between the casing and the tubing, in unit of K; $\overline{Z}$ represents the average deviation factor of natural gas in the wellbore, which is non-dimensional and fractional; Ψ(Press) represents the pseudo-pressure of the pressure $P_{ress}$, in unit of $MPa^2/(mPa\cdot s)$.

Based on the above derived models, according to the preferred embodiment of the present invention, as shown in the FIGURE, a method for evaluating the gas well productivity with eliminating the influence of liquid loading is provided, comprising steps of:

(1) collecting basic data of the liquid loading gas well, comprising the relative density $\gamma_g$ of natural gas, the formation depth H, the formation pore pressure $P_R$, the temperature gradient $T_{grad}$ of fluid in the wellbore during the productivity test, and the well head fluid temperature $T_{head}$, the casing pressure $P_t$, the bottomhole pressure $P_{wfac}$, and the production rate $q_g$ae during the productivity test;

(2) based on the data such as the formation depth H, the temperature gradient $T_{grad}$ of fluid in the wellbore and the well head fluid temperature $T_{head}$ obtained in the step (1), with the reservoir engineering method, obtaining the average temperature $\overline{T}$ of fluid in the annular space between the casing and the tubing;

(3) based on the relative density $\gamma_g$ of natural gas, the formation depth H and the casing pressure $P_t$ of the gas well during the productivity test, which are obtained in the step (1), and the average temperature $\overline{T}$ of fluid in the annular space between the casing and the tubing obtained in the step (2), obtaining the bottomhole pressure $P_{wfn}$ by solving the nonlinear equation of $$P_{wfn}=P_te^{\frac{0.03415\gamma_gH}{\overline{T}\overline{Z}}}$$

iteratively, wherein: $P_{wfn}$ is the bottomhole pressure of the gas well under the condition of no liquid loading; $\overline{Z}$ represents the average gas deviation factor, which is a function of the average temperature $\overline{T}$ of fluid in the annular space between the casing and the tubing and the wellbore average pressure of $\overline{P}=(P_t+P_{wfn})/2$, and can be calculated by the reservoir engineering method;

(4) according to the pseudo-pressure equation of $$\Psi(\text{Press})=2\int_{p_a}^{press}\frac{P}{u_gZ}dP,$$

calculating the related pseudo-pressures $\Psi(P_R)$, $\Psi(P_{wfn})$ and $\Psi(P_{wfac})$ through the numerical integration method, wherein: $\Psi(P_R)$ is the pseudo-pressure of the formation pore pressure; $\Psi(P_{wfn})$ is the pseudo-pressure of the bottomhole pressure of the gas well under the condition of no liquid loading; and $\Psi(P_{wfac})$ is the pseudo-pressure of the bottomhole pressure of the gas well under the condition of liquid loading; and (5) according to the related data obtained in the steps (1)-(4), with the equation of $$q_{AOFN}=6q_{gac}\frac{\Psi(P_R)-\Psi(P_{wfn})}{\Psi(P_R)-\Psi(P_{wfac})}\frac{1}{\sqrt{1+48\left(1-\frac{P_{wfn}^2}{P_R^2}\right)}-1},$$

calculating the absolute open flow rate of the gas well with eliminating the influence of liquid loading.

The meaning of the symbols is illustrated as follows, wherein: $\gamma_g$ represents the relative density of natural gas, which is non-dimensional and fractional; H represents the formation depth, in unit of m; $P_R$ represents the formation pore pressure, in unit of MPa; $T_{grad}$ represents the temperature gradient of fluid in the wellbore, in unit of ° C./(100 m); $T_{head}$ represents the well head fluid temperature during the productivity test, in unit of K; $P_t$ represents the casing pressure during the productivity test; $P_{wfac}$ represents the bottomhole pressure during the productivity test, in unit of MPa; $q_{gac}$ represents the stable production rate during the productivity test, in unit of $m^3/d$; $\overline{T}$ represents the average temperature of fluid in the annular space between the casing and the tubing, in unit of K; $\overline{Z}$ represents the average deviation factor of natural gas in the wellbore, which is non-dimensional and fractional; Ψ(Press) represents the pseudo-pressure of the pressure $P_{ress}$, in unit of $MPa^2/(mPa\cdot s)$.

In other embodiments, the bottomhole pressure $P_{wfn}$ of the gas well under the condition of no liquid loading can be obtained through other methods, namely through the casing pressure $P_t$ of the gas well plus the pressure $\Delta P_{gs}$ generated by the static gas column in the annular space between the casing and the tubing from the well head to the bottomhole; a specific calculation equation is:

$$P_{wfn} = P_t + \int_0^H 0.03415\frac{r_g}{ZT}dh;$$

wherein: T represents the wellbore gas temperature at the depth of h in the annular space between the casing and the tubing; Z represents the gas deviation factor; $\Delta P_{gs}$ represents the pressure generated by the static gas column in the annular space between the casing and the tubing from the well head to the bottomhole, and it can be calculated by the equation of $$\Delta P_{gs} = \int_0^H 0.03415\frac{r_g}{ZT}dh.$$

Example for Verification

One gas well is taken as an example as follows, so as to verify the gas well productivity evaluation method with eliminating the influence of liquid loading, provided by the present invention. The conditions of the gas well are described as follows.

For the gas well, a vertical depth at the middle of the formation is 3107 m; a formation pore pressure is 23.88 MPa; a casing pressure actually measured on Jul. 6, 2018, is 9.6 MPa; a tubing pressure is 3.7 MPa; a bottomhole pressure is 15.53 MPa; a well head temperature is 29° C.; a temperature gradient in the wellbore is 2.2861° C./100; a formation temperature is 100.03° C.; a stable daily gas production rate is 29704 $m^3/d$; and a daily water production rate is 30.48 $m^3/d$. It is obtained through the experimental analysis that the relative density of natural gas is 0.626; the critical pressure is 4.6235 MPa; and the critical temperature is 202.7516 K. At that time, slight liquid loading exists in the gas well.

With the productivity evaluation method provided by the preferred embodiment, the productivity of the gas well is evaluated through steps of:

(1) collecting the basic data of the liquid loading gas well, wherein: the relative density $\gamma_g$ of natural gas is $\gamma_g$=0.626; the formation depth H is H=3107 m; the formation pore pressure $P_R$ is $P_R$=23.88 MPa; the temperature gradient $T_{grad}$ of fluid in the wellbore during the productivity test is $T_{grad}$=2.2861° C./(100 m); the well head fluid temperature $T_{head}$, the casing pressure $P_t$, the bottomhole pressure $P_{wfac}$, and the production rate $q_{gac}$ during the productivity test are respectively $T_{head}$=29+273 0.15=302.15 K, $P_t$=9.6 MPa, $P_{wfac}$15.53 MPa and $q_{gac}$=29704 $m^3/d$;

(2) based on the data such as the formation depth H (H=3107 m), the temperature gradient $T_{grad}$ of fluid in the wellbore ($T_{grad}$=2.2861° C./(100 m)) and the well head fluid temperature $T_{head}$ ($T_{head}$=302.15 K), obtained in the step (1), with the equation of $$\overline{T} = \left(T_{head} + \frac{H}{100} \times T_{grad} + 273.15\right)\Big/2,$$

obtaining the average temperature $\overline{T}$ of fluid in the annular space between the casing and the tubing of $\overline{T}$=323.16 K;

(3) putting the relative density $\gamma_g$ of natural gas ($\gamma_g$=0.626), the formation depth H (H=3107 m) and the casing pressure $P_t$ of the gas well during the productivity test ($P_t$=9.6 MPa), which are obtained in the step (1), and the average temperature $\overline{T}$ of fluid in the annular space between the casing and the tubing ($\overline{T}$=323.16 K) obtained in the step (2) into the bottomhole pressure model of static gas column of $$P_{wfn} = P_t e^{\frac{0.03415\gamma_g H}{\overline{T}\overline{Z}}},$$

and obtaining the bottomhole pressure $P_{wfn}$ of the gas well under the condition of no liquid loading, $$P_{wfn} = 9.6e^{\frac{0.2055}{\overline{Z}}} = 9.6e^{\frac{0.2055}{\overline{Z}\left(\overline{T}_r\left(P_t+P_{wfn}\right)/2\right)}};$$

wherein: the average gas deviation factor $\overline{Z}$ is the function of the average temperature $\overline{T}$ of fluid in the annular space between the casing and the tubing and the wellbore average pressure of $\overline{P}=(P_t+P_{wfn})/2$; during the iterative solution, the iterative assumed value of $P_{wfn}$ is substituted, and with the reservoir engineering method, the value of $\overline{Z}$ can be calculated according to the obtained average temperature $\overline{T}$ of fluid in the annular space between the casing and the tubing and the wellbore average pressure $\overline{P}$; the iterative value of $P_{wfn}$ is continuously assumed, until $$\left|P_{wfn} - 9.6e^{\frac{0.2055}{\overline{Z}\left(\overline{T}_r\left(P_t+P_{wfn}\right)/2\right)}}\right| \le 0.001,$$

and the iterative assumed value at this time is the solution of the non-linear equation; through the iterative solution, the bottomhole pressure under the condition of no liquid loading is obtained that $P_{wfn}$=12.11 MPa;

(4) according to the pseudo-pressure equation of $$\Psi(\text{Press}) = 2\int_{P_a}^{Press}\frac{P}{u_g Z}dP \text{ and } P_a = 0.101 \text{ MPa},$$

calculating the related pseudo-pressures $\Psi(P_R)$, $\Psi(P_{wfn})$ and $\Psi(P_{wfac})$ under the formation temperature of 373.18 K through the numerical integration method, wherein: $\Psi(P_R)$=Ψ(2388)=35810.42, $\Psi(P_{wfn})$=Ψ(12.11)=10430.56, and $\Psi(P_{wfac})$=Ψ(15.53)=16680.32;

(5) according to the related data obtained in the steps (1)-(4), with the equation of $$q_{AOFN} = 6q_{gac}\frac{\Psi(P_R)-\Psi(P_{wfn})}{\Psi(P_R)-\Psi(P_{wfc})}\frac{1}{\sqrt{1+48\left(1-\frac{P_{wfn}^2}{P_R^2}\right)}-1},$$

calculating the absolute open flow rate of the gas well with eliminating the influence of liquid loading, wherein:

$$q_{AOF} = 6\times 29704\times\frac{35810.42-10430.50}{35810.42-16680.32}\times\frac{1}{\sqrt{1+48\left(1-\frac{12.11^2}{23.88^2}\right)}-1} = 46780.82\ \mathrm{m^3/d}$$

According to the gas well productivity evaluation equation of $$q_{AOF} = \frac{6q_g}{\sqrt{1+48\left(1-\frac{P_{wf}^2}{P_R^2}\right)}-1}$$

without considering the influence of liquid loading, the obtained absolute open flow rate is $$q_{AOF} = \frac{6\times 29704}{\sqrt{1+48\left(1-\frac{15.53^2}{23.88^2}\right)}-1} = 40903.77\ \mathrm{m^3/d}.$$

It can be seen from the above analysis that: if taking measures, the absolute open flow rate of the gas well with eliminating the influence of liquid loading reaches 46780.82 $m^3$/d, which is higher than the absolute open flow rate of 40903.77 $m^3$/d under the condition of slight liquid loading by 14.37%. The above result indicates that: if the influence of liquid loading is eliminated, the gas well productivity is obviously increased, which is consistent with the engineering practice conclusion, so that the reliability of the present invention is verified.

The above-described embodiment is the preferred embodiment of the present invention, but the implementation of the present invention is not limited thereto. The changes made without departing from the present invention are all the equivalent replacements, which should be encompassed in the protection scope of the present invention.

The invention claimed is:

1. A method for evaluating a gas well productivity with eliminating an influence of liquid loading, comprising steps of:

(1) collecting basic data of a liquid loading gas well, comprising a relative density $\gamma_g$ of natural gas, a formation depth H, a formation pore pressure $P_R$, and a casing pressure $P_t$, a bottomhole pressure $P_{wfac}$, and a production rate $q_{gac}$, during a productivity test;

(2) based on the relative density $\gamma_g$ of natural gas, the formation depth Hand the casing pressure $P_t$ of the gas well during the productivity test, which are obtained in the step (1), determining a pressure generated by a static gas column in an annular space between a casing and a tubing from a well head to a bottomhole of the gas well, and calculating a bottomhole pressure $P_{wfn}$ of the gas well under a condition of no liquid loading;

(3) according to a pseudo-pressure equation of $$\Psi(\mathrm{Press}) = 2\int_{P_a}^{Press}\frac{P}{u_g Z}dP,$$

calculating a pseudo-pressure $\Psi(P_R)$ of the formation pore pressure, a pseudo-pressure $\Psi(P_{wfn})$ of the bottomhole pressure under the condition of no liquid loading, and a pseudo-pressure $\Psi(P_{wfac})$ of the bottomhole pressure under a condition of liquid loading;

wherein: $P_a$ represents an atmospheric pressure, $u_g$ represents a gas viscosity, and Z represents a gas deviation factor;

(4) according to the production rate $q_{gac}$ of the gas well under the condition of liquid loading in the step (1) and the pseudo-pressures $\Psi(P_R)$, $\Psi(P_{wfac})$ and $\Psi(P_{wfac})$ in the step (3), determining a production rate $q_{gn}$ of the gas well under the condition of no liquid loading, wherein: a calculation equation of the production rate $q_{gn}$ for the gas well under the condition of no liquid loading is:

$$q_{gn} = q_{gac}\frac{\Psi(P_R)-\Psi(P_{wfn})}{\Psi(P_R)-\Psi(P_{wfac})};$$

and (5) according to the production rate $q_{gn}$ of the gas well under the condition of—no liquid loading obtained in the step (4) and the bottomhole pressure $P_{wfn}$ of the gas well under the condition of no liquid loading obtained in the step (2), calculating an absolute open flow rate of the gas well with eliminating the influence of liquid loading.

2. The method according to claim 1, wherein: a calculation equation of the absolute open flow rate of the gas well with eliminating the influence of liquid loading is:

$$q_{AOFN} = 6q_{gac}\frac{\Psi(P_R)-\Psi(P_{wfn})}{\Psi(P_R)-\Psi(P_{wfac})}\frac{1}{\sqrt{1+48\left(1-\frac{P_{wfn}^2}{P_R^2}\right)}-1};$$

wherein: $q_{AOFN}$ represents the absolute open flow rate of the gas well with eliminating the influence of liquid loading.

3. The method according to claim 1, wherein: the collected basic data of the liquid loading gas well further comprise a temperature gradient $T_{grad}$ of fluid in a wellbore during the productivity test and a well head fluid temperature $T_{head}$ during the productivity test;

based on the formation depth H obtained in the step (1), the temperature gradient $T_{grad}$ of fluid in the wellbore, and the well head fluid temperature $T_{head}$, an average temperature $\overline{T}$ of fluid in the annular space between the casing and the tubing is obtained with a reservoir engineering method;

based on the relative density $\gamma_g$ of natural gas, the formation depth H and the casing pressure $P_t$ of the gas well during the productivity test, which are obtained in the step (1), and the calculated average temperature $\overline{T}$ of fluid in the annular space between the casing and the tubing, which is obtained above, the bottomhole pressure $P_{wfn}$ of the gas well under the condition of no liquid loading is obtained by solving a nonlinear equation of $$P_{wfn} = P_t e^{\frac{0.3415 y_g H}{\overline{T}\overline{Z}}}$$

iteratively, wherein: $\overline{Z}$ represents an average gas deviation factor, which is a function of the average temperature $\overline{T}$ of fluid in the annular space between the casing and the tubing and a wellbore average pressure of $\overline{P}=(P_t+P_{wfn})/2$, and is calculated by the reservoir engineering method;

or, with a model of $$P_{wfn} = P_t + \int_0^H 0.03415 \frac{r_g}{ZT} dh,$$

the bottomhole pressure $P_{wfn}$ of the gas well under the condition of no liquid loading is calculated, wherein: T represents a wellbore gas temperature at a depth of h in the annular space between the casing and the tubing, and Z represents the gas deviation factor.

* * * * *